US009079438B1

(12) United States Patent
Ishikawa et al.

(10) Patent No.: US 9,079,438 B1
(45) Date of Patent: Jul. 14, 2015

(54) PRINTER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/629,590

(22) Filed: Feb. 24, 2015

(30) Foreign Application Priority Data

Feb. 28, 2014 (JP) ..... 2014-039618

(51) Int. Cl.
*B41J 11/70* (2006.01)

(52) U.S. Cl.
CPC ..... *B41J 11/70* (2013.01)

(58) Field of Classification Search
CPC ..... B41J 11/04; B41J 11/66; B41J 11/70; B41J 15/04
See application file for complete search history.

(56) References Cited

U.S. PATENT DOCUMENTS

| | | | | |
|---|---|---|---|---|
| 6,602,008 | B2 * | 8/2003 | Yamagishi et al. | 400/619 |
| 6,814,515 | B2 * | 11/2004 | Tsuchiya et al. | 400/621 |
| 6,889,031 | B2 * | 5/2005 | Tsuchida | 399/401 |
| 2012/0057918 | A1 * | 3/2012 | Eoka | 400/621 |

FOREIGN PATENT DOCUMENTS

| | | |
|---|---|---|
| JP | 2003-019845 | 1/2003 |

* cited by examiner

*Primary Examiner* — Sarah Al Hashimi
(74) *Attorney, Agent, or Firm* — IPUSA, PLLC

(57) ABSTRACT

A printer includes a cutter unit configured to cut recording paper, and a presenter unit, wherein the recording paper enters the presenter unit through the cutter unit, and the presenter unit includes a first roller and a second roller configured to convey the recording paper, a flapper disposed under a transport path of the recording paper between a position of the first and second rollers and a position of the cutter unit, and configured to be flipped open to provide an opening in the transport path, and a paper guide disposed over the transport path of the recording paper between the position of the first and second rollers and the position of the cutter unit, wherein, upon the flapper being flipped open to outside the presenter unit, the paper guide changes a position thereof to guide the recording paper to outside the presenter unit through the opening.

7 Claims, 11 Drawing Sheets

PRINTER

BACKGROUND OF THE INVENTION

1. Field of the Invention

The disclosures herein relate to a printer.

2. Description of the Related Art

Printers for producing sales receipts or the like are widely used in cash registers used in stores, ATMs (automatic teller machines) or CDs (cash dispensers) installed in banks, etc. In a printer for producing sales receipts or the like, a thermal head or the like prints on thermal paper serving as recording paper while the recording paper is advanced. After the recording paper is advanced a predetermined length, a predetermined length of the recording paper is cut from the rest of the paper. A cutter has a fixed blade and a movable blade. The movable blade is moved toward the fixed blade to cut recording paper that is placed between the fixed blade and the movable blade.

Such a printer may be provided with a presenter connected thereto for the purpose of allowing a printed recording sheet to be removed by the user. The presenter has a recording sheet placed therein that is printed by a thermal head or the like and cut by a cutter. The recording sheet that is cut by the cutter to have a predetermined length has a portion thereof exposed from a discharge slot and placed in the presenter so that the sheet can be removed by the user. Upon the recording sheet being removed by the user, the print operation by the printer comes to completion. If a predetermined time length passes without the recording sheet being removed by the user, the printed recording sheet is retracted into the presenter.

A printer apparatus such as a thermal printer utilizes a roll of recording paper. When the recording paper has strong curl or has a thin thickness, and is long, the recording paper may end up being folded or jammed in the presenter.

Accordingly, it may be desired to provide a printer having a presenter in which a recording sheet is neither folded nor jammed.

[Patent Document 1] Japanese Laid-open Patent Publication No. 2003-19845

SUMMARY OF THE INVENTION

It is a general object of the present invention to provide a printer that substantially obviates one or more problems caused by the limitations and disadvantages of the related art.

According to an embodiment, a printer includes a printer main body having a print head to print on recording paper and a platen roller, a cutter unit configured to cut the recording paper, and a presenter unit connected to the cutter unit, wherein the recording paper on which the print head has printed enters the presenter unit through the cutter unit, and comes out from a discharge slot of the presenter unit, and wherein the presenter unit includes a first roller and a second roller configured to convey the recording paper, a flapper disposed under a transport path of the recording paper between a position of the first roller and the second roller and a position of the cutter unit, and configured to be flipped open to provide an opening in the transport path, and a recording paper transport guide disposed over the transport path of the recording paper between the position of the first roller and the second roller and the position of the cutter unit, wherein, upon the flapper being flipped open to outside the presenter unit, the recording paper transport guide changes a position thereof to guide the recording paper to outside the presenter unit through the opening.

According to at least one embodiment, a printer having a presenter is provided in which a recording sheet is neither folded nor jammed.

BRIEF DESCRIPTION OF TEE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments will be described by referring to the accompanying drawings. The same or similar elements are referred to by the same or similar numerals.

Figure 1:
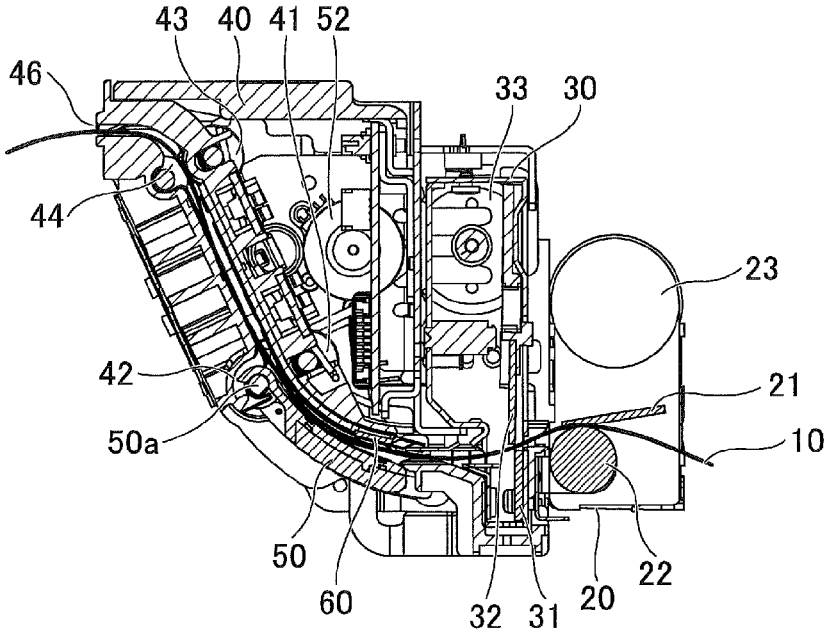
FIG. 1 is a drawing illustrating an example of the configuration of a printer according to an embodiment.
Figure 2:
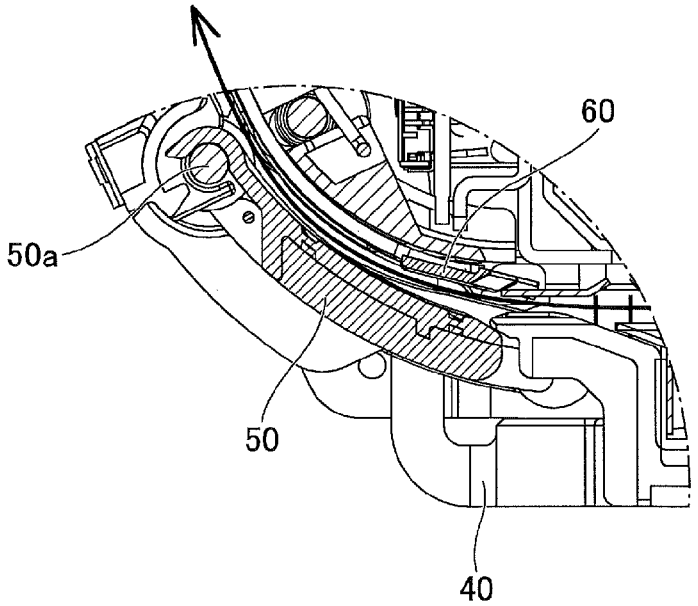
FIG. 2 is an enlarged view of a main part of the printer according to the embodiment.
Figure 3:
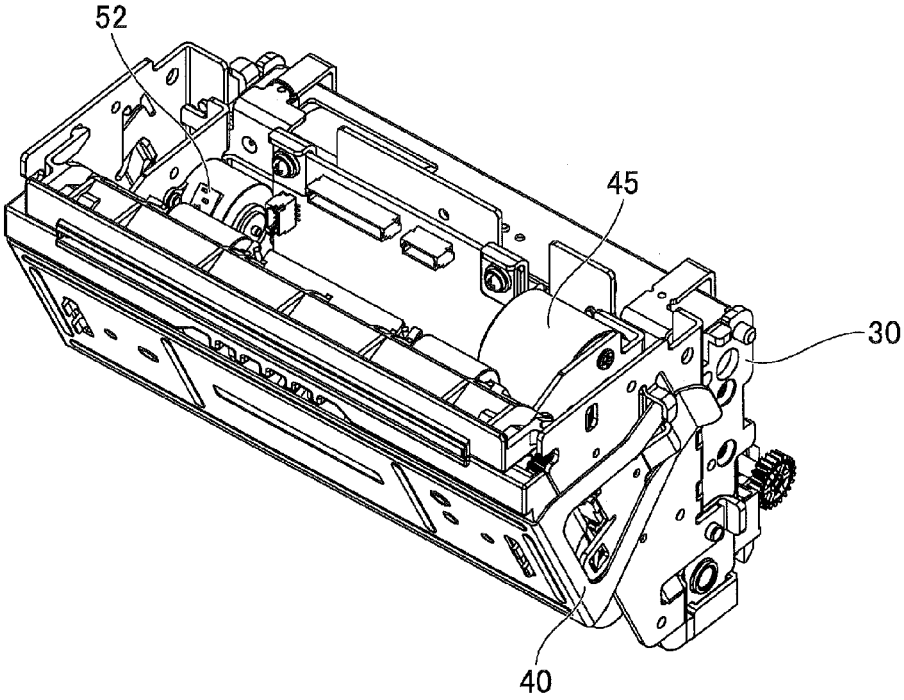
FIG. 3 is an oblique perspective view of the printer according to the embodiment.
Figure 4:
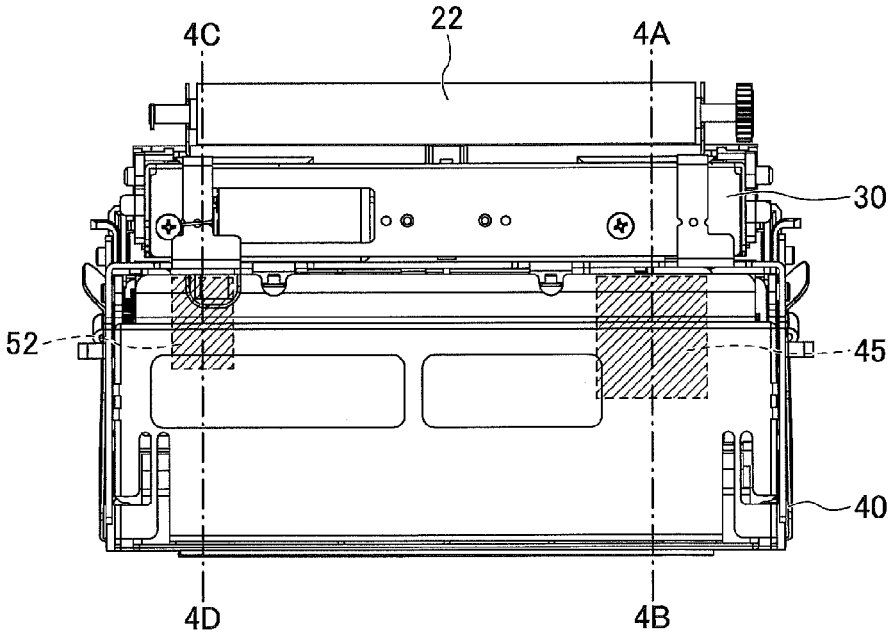
FIG. 4 is a top view of the printer according to the embodiment.
Figure 5:
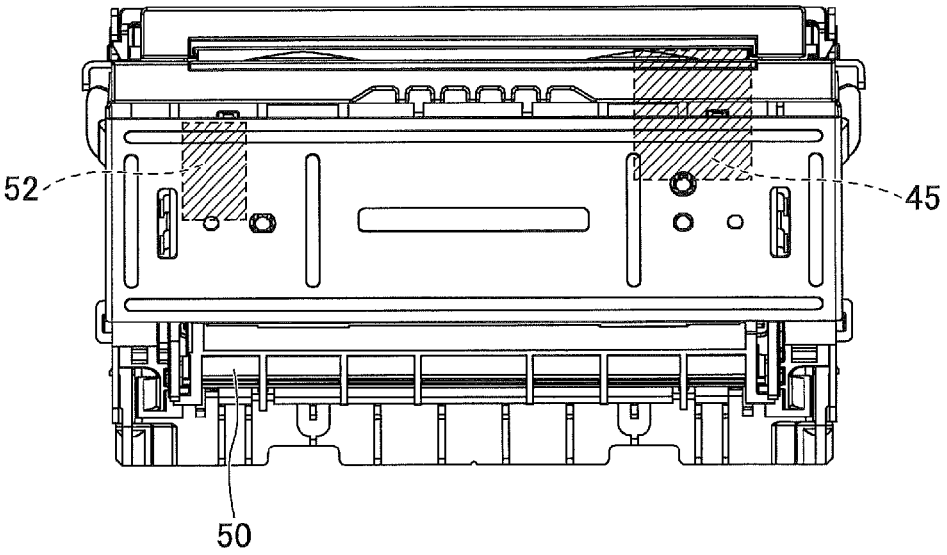
FIG. 5 is a front view of the printer according to the embodiment.
Figure 6:
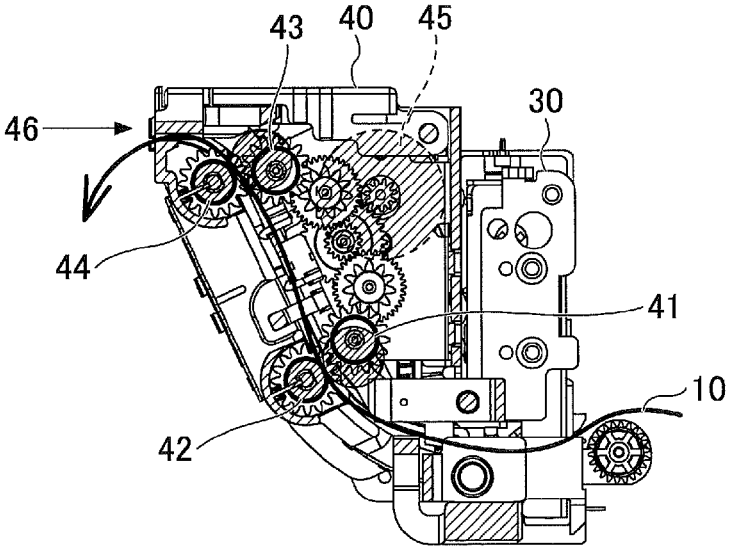
FIG. 6 is a cross-sectional view of the printer according to the embodiment.
Figure 7:
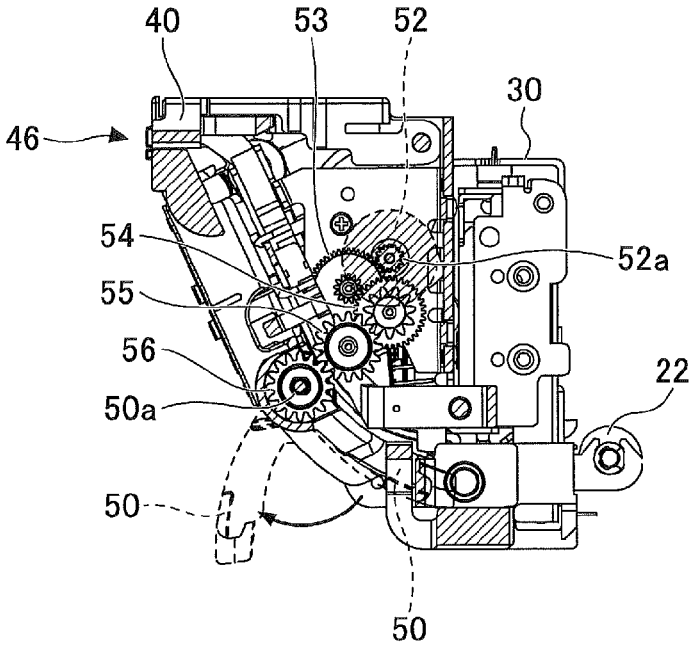
FIG. 7 is a cross-sectional view of the printer according to the embodiment.

A printer according to the present embodiment will be described with reference to FIGS. 1 through 7. FIG. 1 is a drawing illustrating an example of the structure of a printer according to the present embodiment. FIG. 2 is an enlarged view of a main part of the printer illustrated in FIG. 1. FIG. 3 is an oblique perspective view of the printer according to the present embodiment. FIG. 4 is a top view of the printer according to the present embodiment. FIG. 5 is a front view of the printer according to the present embodiment. FIG. 6 is a cross-sectional view of the printer taken along a line 4A-4B illustrated in FIG. 4. FIG. 7 is a cross-sectional view of the printer taken along a line 4C-4D illustrated in FIG. 4. FIG. 6 also illustrates recording paper 10 for the purpose of providing a clear view of a transport path of the recording paper 10.

The printer of the present embodiment prints on the recording paper 10 that is supplied from a paper roll. The printer includes a printer main body 20, a cutter unit 30, and a presenter unit 40. In the present embodiment, the printer main body and the cutter unit 30 are connected to each other, and the cutter unit 30 and the presenter unit 40 are connected to each other.

The printer main body 20 includes a thermal head 21 serving as a print head for printing on the recording paper 10, a platen roller 22, and a transport motor 23 for conveying the recording paper 10. The recording paper 10 is fed into the printer main body 20 through a transport slot. The cutter unit 30 includes a fixed blade 31, a movable blade 32, a movable-blade motor 33 for driving the movable blade 32, and gears and the like (not shown) for transmitting the driving force generated by the rotation of the movable-blade motor 33 to the movable blade 32.

In the printer main body 20, the transport motor 23 rotates to rotate the platen roller 22 while the recording paper 10 is placed between the thermal head 21 and the platen roller 22, thereby conveying the recording paper 10. The thermal head 21 prints on the recording paper 10 being conveyed by the rotation of the platen roller 22.

The printed recording paper 10 is then cut by the cutter unit 30. Specifically, upon the printed portion of the recording paper 10 being moved to a predetermined location, the movable-blade motor 33 rotates to move the movable blade 32 toward the fixed blade 31, thereby cutting the recording paper 10 between the fixed blade 31 and the movable blade 32.

The presenter unit 40 includes a first roller 41, a second roller 42, a third roller 43, a fourth roller 44, a transport roller 45, a flapper 50, and a recording paper transport guide 60, which are provided for the purpose of conveying printed recording paper. The first roller 41 and the second roller 42 are disposed to face each other, and the third roller 43 and the fourth roller 44 are disposed to face each other. Both the first roller and the third roller 43 are rotated by a drive force transmitted through gears from the rotating transport roller 45. The second roller 42 rotates by following the rotation of the first roller 41, and the fourth roller 44 rotates by following the rotation of the third roller 43. With this arrangement, the recording paper 10 placed between the first roller 41 and the second roller 42 and placed between the third roller 43 and the fourth roller 44 is conveyed inside the presenter unit 40. The recording paper 10 conveyed in the presenter unit 40 is exposed from a discharge slot 46. The user pulls out the recording paper 10 from the discharge slot 46 to remove the recording paper 10.

The length of the recording paper 10 upon being cut is dependent on the usage thereof, so that the position at which the recording paper 10 is cut also varies. The length of the transport path of the recording paper 10 inside the presenter unit 40 is constant. There may be a case in which the recording paper 10 is cut to have a long length, which may be longer than the entire length of the transport path. In such a case, the recording paper 10 may need to have a slack inside the presenter unit 40. In the present embodiment, as illustrated by dotted lines in FIG. 7, the flapper 50 of the presenter unit 40 is flipped open to outside the presenter unit 40, thereby providing a slack in the printed recording paper 10 extending to outside the presenter unit 40. With this arrangement, the recording paper 10 can be cut to have a desired length even if the length of the recording paper 10 to be discharged is longer than the entire length of the transport path of the recording paper 10 inside the presenter unit 40.

The flapper 50 is connected to the presenter unit 40 such as to be rotatable around a rotation axis 50*a*. A flapper drive motor 52 disposed inside the presenter unit 40 rotates to flip open the flapper 50. Specifically, a first gear 53, a second gear 54, a third gear 55, and a fourth gear 56 are provided in the presenter unit 40. The first gear 53 is connected to a gear 52*a* of the flapper drive motor 52. Rotation of the flapper drive motor 52 causes the gear 52*a* of the flapper drive motor 52, the first gear 53, the second gear 54, the third gear 55, and the fourth gear 56 to rotate, thereby causing the flapper 50 to rotate around the rotation axis 50*a* to flip open.

The recording paper 10 used in the printer of the present embodiment may be supplied from a roll of recording paper, so that the recording paper 10 has curl. The use of such curled recording paper 10, especially the use of strongly curled recording paper 10, may give rise to a situation in which the opened flapper 50 fails to create a sufficient slack in the recording paper 10, resulting in the recording paper 10 being folded or jammed. The same applies in the case of the recording paper 10 that is thin.

In the printer of the present embodiment, as illustrated in FIG. 2, for example, the recording paper transport guide 60 is provided in the presenter unit 40. When the flapper 50 of the presenter unit 40 is closed, the recording paper transport guide 60 is situated deeper into the presenter unit 40 than is the flapper 50, and is supported by the flapper 50. Specifically, the recording paper transport guide 60 is situated further toward the inside than the transport path of the recording paper 10, and faces the flapper 50 across the transport path of the recording paper 10. Namely, the recording paper transport guide 60 is situated further toward the inside than the transport path of the recording paper 10, and the flapper 50 is situated further toward the outside than the transport path of the recording paper 10. Upon the flapper 50 being flipped open, the recording paper transport guide 60 is also flipped toward the outside as the support by the flapper 50 become nonexistent. When the flapper 50 is closed and the recording paper 10 is situated in the transport path between the flapper 50 and the recording paper transport guide 60, the recording paper transport guide 60 is supported by the flapper 50 via the recording paper 10.

Figure 8:
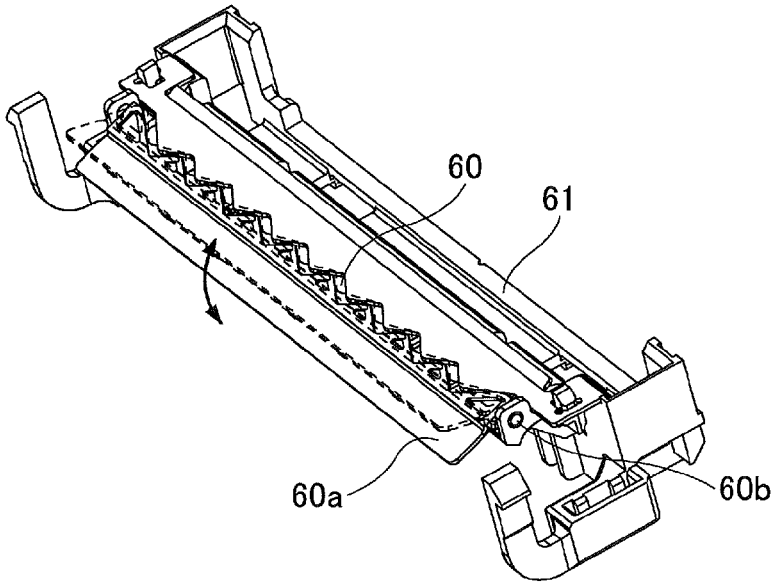
FIG. 8 is an oblique perspective view of a recording paper transport guide of the printer according to the embodiment.

The recording paper transport guide 60 may be flipped toward the outside due to its own weight. Alternatively, a restoration member exerting a restorative force such as a spring may be provided, and the recording paper transport guide 60 may be flipped toward the outside by the restorative force of the restoration member. As illustrated in FIG. 8, the recording paper transport guide 60 is connected in a rotatable manner to a mount member 61, which is provided to attach the recording paper transport guide 60 to the presenter unit 40. Specifically, the recording paper transport guide 60 has a guide unit 60*a* for guiding the recording paper 10, and rotates around a rotation axis 60*b* so that the direction of the guide unit 60*a* changes as illustrated by an arrow in FIG. 8. With this arrangement, the recording paper transport guide 60 is flipped toward the outside, thereby changing the travel direction of the recording paper 10 such as to place the recording paper 10 outside the presenter unit 40.

Figure 9A:
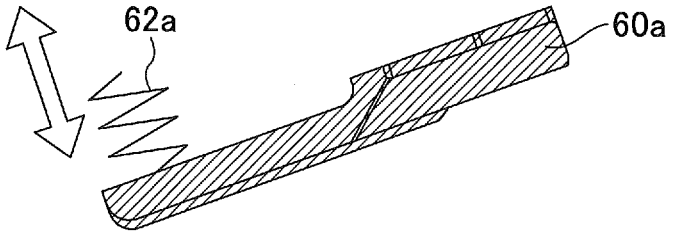
FIGS. 9A through 9D are drawings illustrating the recording paper transport guide of the printer according to the embodiment.
Figure 9B:
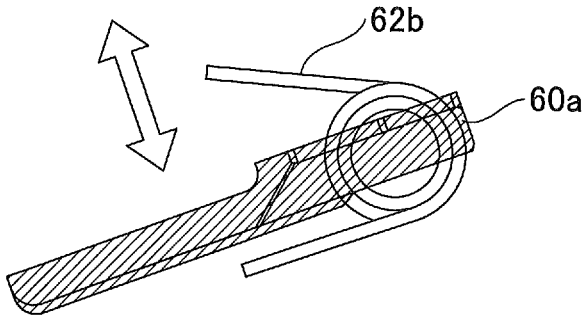
Figure 9C:
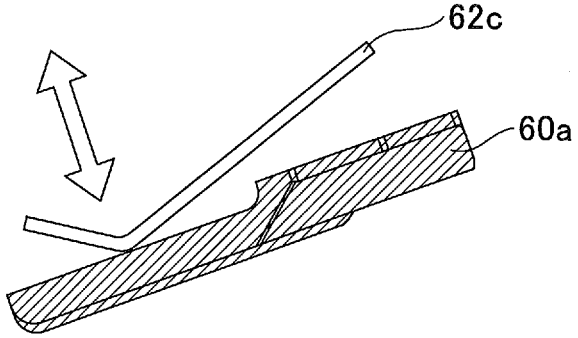
Figure 9D:
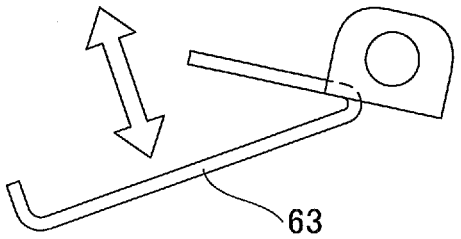

Examples of the spring or the like that exerts a restorative force to the recording paper transport guide 60 include the following configurations. As illustrated in FIG. 9A, a coil spring 62*a* may be disposed on the guide unit 60*a*, which is thus moved downward by the restorative force of the coil spring 62*a* as the flapper 50 is flipped open. As illustrated in FIG. 9B, a helical torsion spring 62*b* may be disposed around the rotation axis of the guide unit 60*a*, which is thus moved downward by the restorative force of the helical torsion spring 62*b* as the flapper 50 is flipped open. As illustrated in FIG. 9C, a leaf spring 62*c* may be disposed on the guide unit 60*a*, which is thus moved downward by the restorative force of the leaf spring 62C as the flapper 50 is flipped open. As illustrated in FIG. 9D, a recording paper transport guide 63 made of a leaf spring may be employed in place of the guide unit 60*a*. In this case, as the flapper 50 is flipped open, part of the recording paper transport guide 63 moves downward by the restorative force of the recording paper transport guide 63 made of a leaf spring.

In the following, a description will be given of the opening and closing of the flapper 50 of the presenter unit 40.

Figure 10:
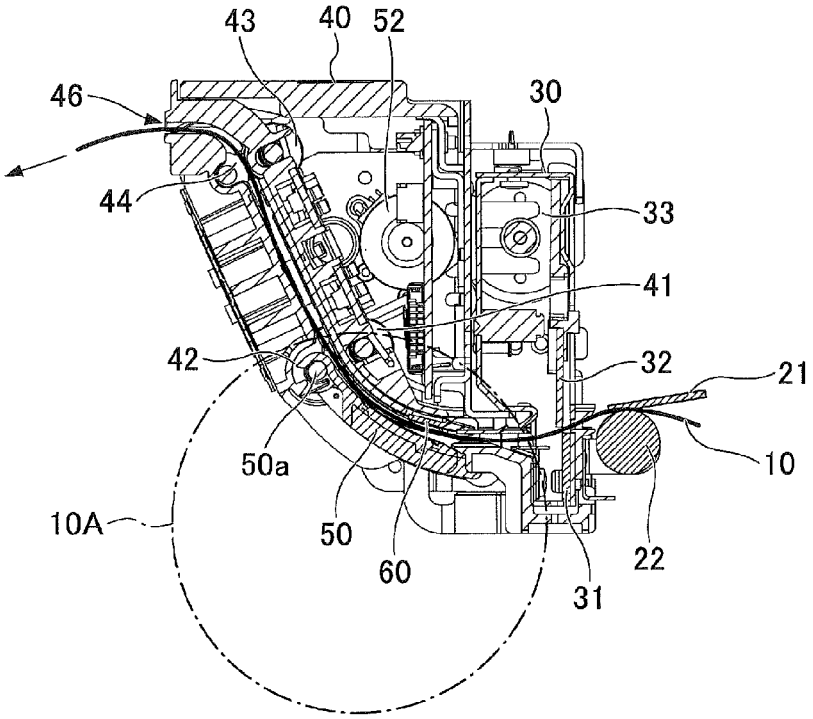
FIG. 10 is a drawing illustrating the opening and closing of a flapper of the printer according to the embodiment.
Figure 11:
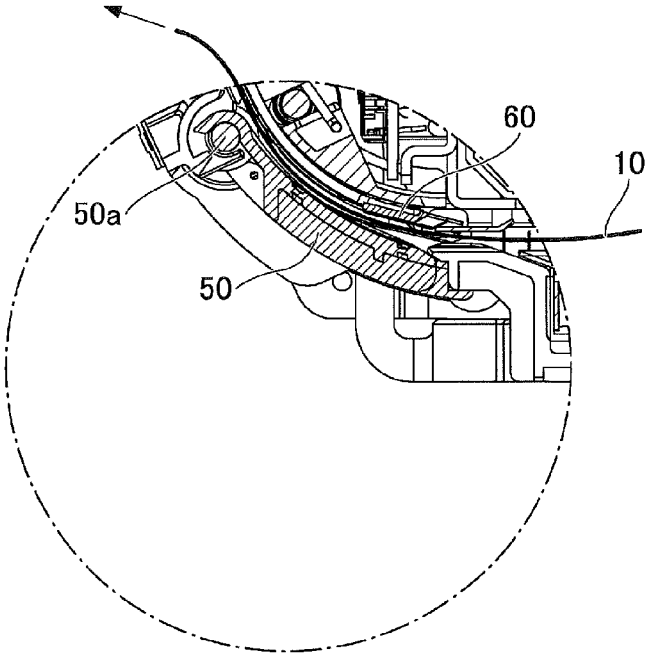
FIG. 11 is an enlarged view of a main part of the printer illustrated in FIG. 10.

As illustrated in FIG. 10 and FIG. 11, the recording paper 10 on which the thermal head 21 has printed passes through the cutter unit 30, and enters the transport path situated inside the presenter unit 40. As this happens, the recording paper 10 being conveyed is placed between the first roller 41 and the second roller 42 and between the third roller 43 and the fourth roller 44 inside the presenter unit 40. In this state, the flapper 50 is closed, so that the recording paper transport guide is placed in its original position. The flapper is situated under the transport path of the recording paper 10, and the recording paper transport guide 60 is situated over the transport path of the recording paper 10. In this state, thus, the recording paper 10 passes through the transport path between the flapper 50 and the recording paper transport guide 60. FIG. 11 is an enlarged view of a portion enclosed by a chain-line circle 10A in FIG. 10.

Figure 12:
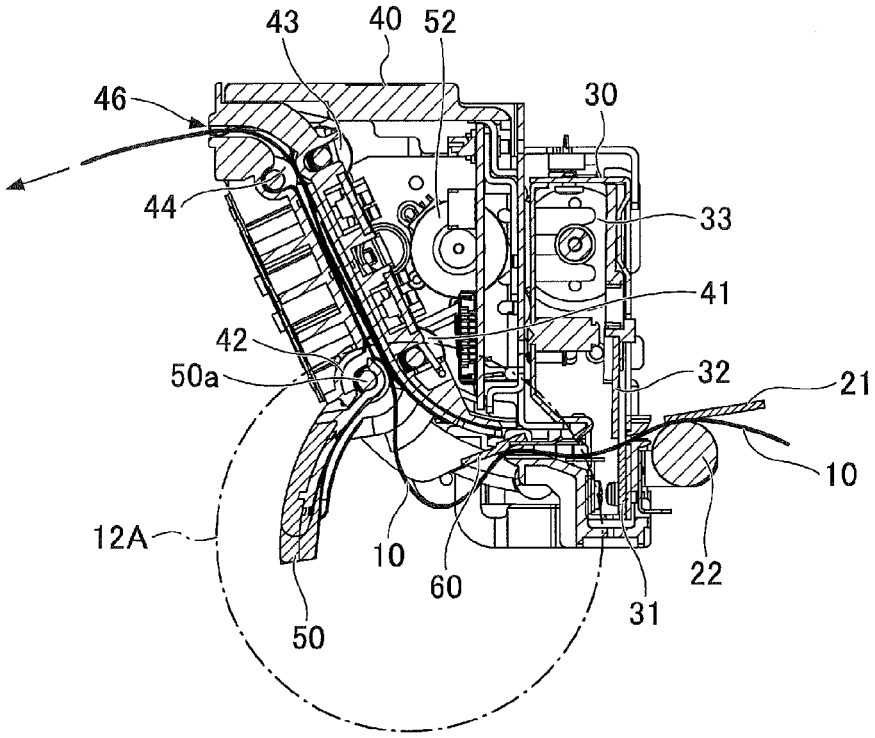
FIG. 12 is a drawing illustrating the opening and closing of the flapper of the printer according to the embodiment.
Figure 13:
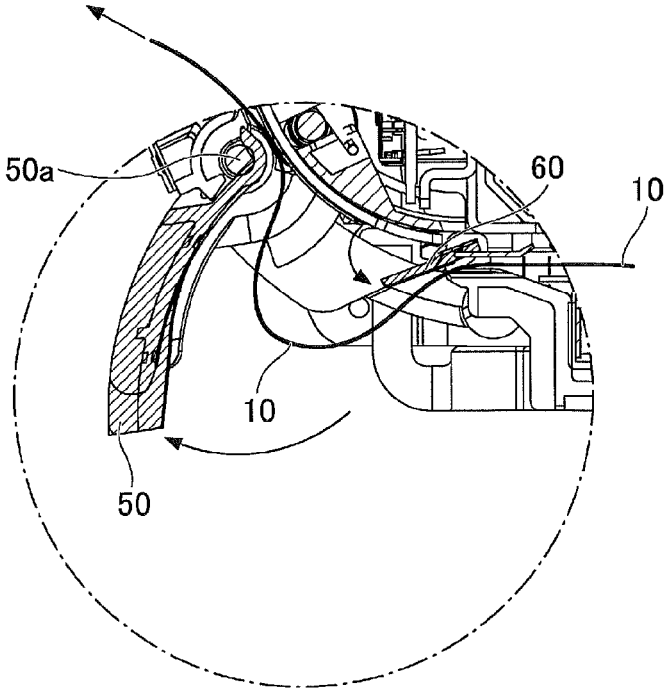
FIG. 13 is an enlarged view of a main part of the printer illustrated in FIG. 12.

Thereafter, as illustrated in FIG. 12 and FIG. 13, the rotations of the first roller 41 and the second roller 42 and the rotations of the third roller 43 and the fourth roller 44 in the presenter unit 40 are stopped, and the flapper 50 is flipped open. In this state, the recording paper 10 on which the thermal head 21 has printed passes through the cutter unit 30 to enter the inside of the presenter unit 40. Since the first roller 41 and the other rollers are not rotating, the recording paper 10 will produce a slack that extends to outside the presenter unit 40 through the space provided by the opened flapper 50. When this happens, the head end of the printed recording paper 10 is exposed from the discharge slot 46.

In the present embodiment, the flapper 50 of the presenter unit 40 is flipped open, and, together therewith, the recording paper transport guide 60 is flipped toward the outside, so that the guide unit 60*a* of the recording paper transport guide 60 is directed downward. As a result, the flipped guide unit 60*a* guides the recording paper 10 to outside the presenter unit 40. This arrangement creates a desired slack in the recording paper 10 without causing the recording paper 10 to be folded despite the presence of strong curl in the recording paper 10. FIG. 13 is an enlarged view of a portion enclosed by a chain-line circle 12A in FIG. 12.

Figure 14:
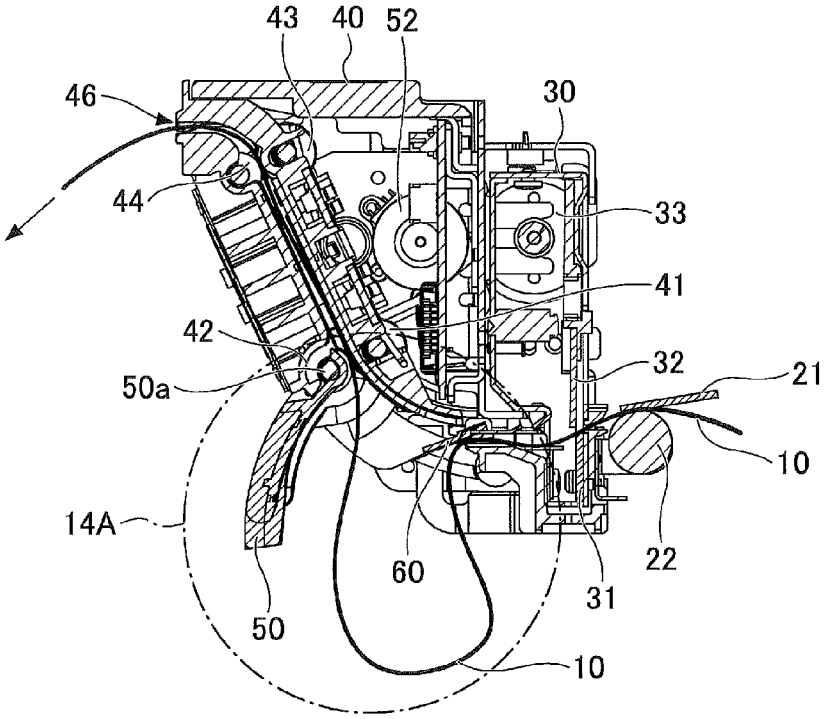
FIG. 14 is a drawing illustrating the opening and closing of the flapper of the printer according to the embodiment.
Figure 15:
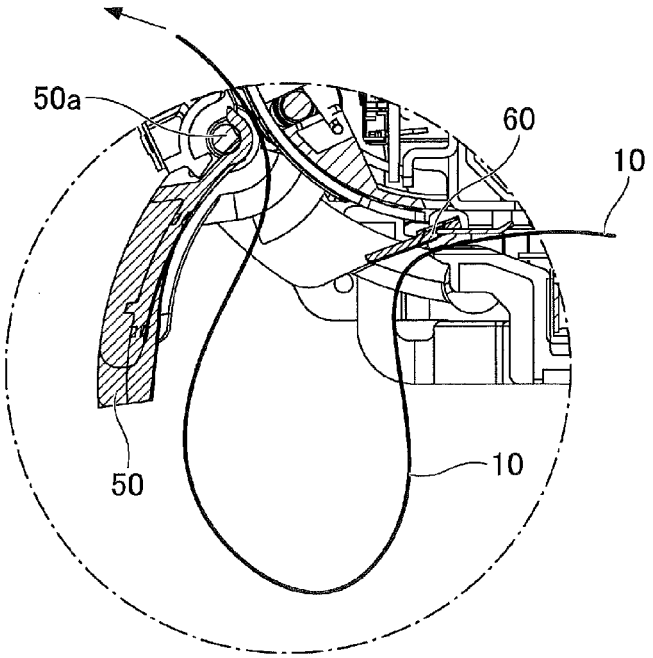
FIG. 15 is an enlarged view of a main part of the printer illustrated in FIG. 14.

As illustrated in FIG. 14 and FIG. 15, the platen roller 22 is rotated while the rotations of the first roller 41 and the second roller 42 and the rotations of the third roller 43 and the fourth roller 44 in the presenter unit 40 do not exist. This causes the recording paper 10 to further advance into the presenter unit 40 through the cutter unit 30. In the state illustrated in FIG. 14 and FIG. 15, the flapper 50 is open, so that the recording paper 10 printed by the thermal head 21 passes through the cutter unit 30 to further advance to outside the presenter unit 40 through the space provided by the open flapper 50. This serves to increase the amount of slack. FIG. 15 is an enlarged view of a portion enclosed by a chain-line circle 14A in FIG. 14.

Figure 16:
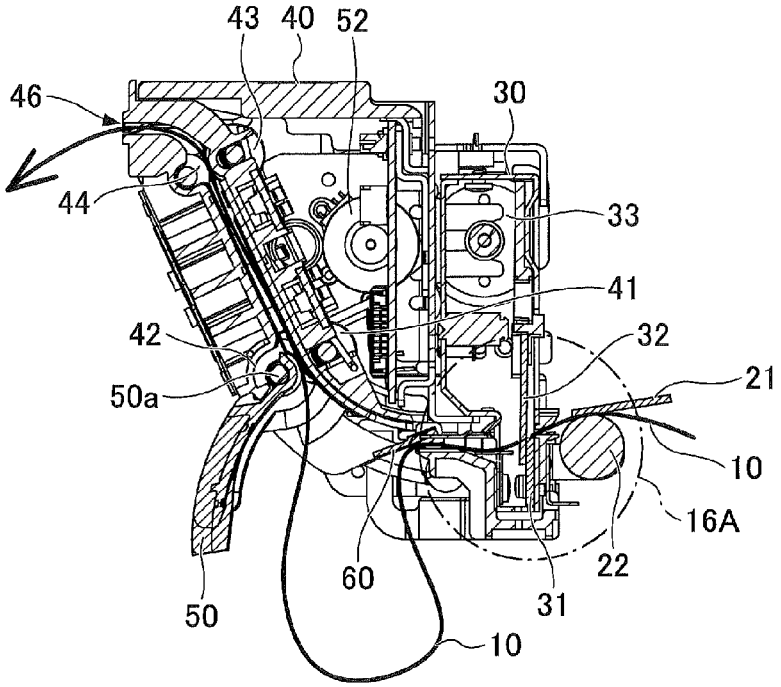
FIG. 16 is a drawing illustrating the opening and closing of the flapper of the printer according to the embodiment.
Figure 17:
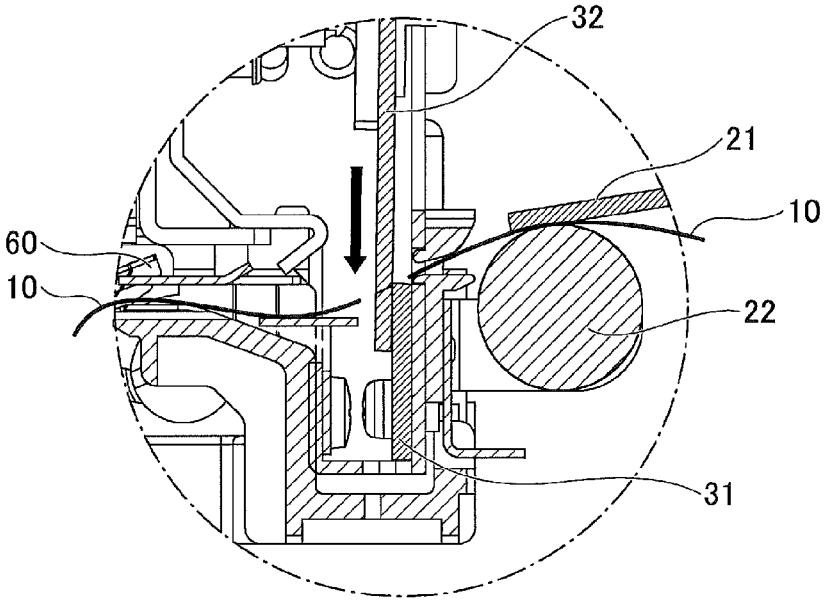
FIG. 17 is an enlarged view of a main part of the printer illustrated in FIG. 16.

Subsequently, as illustrated in FIG. 16 and FIG. 17, the cutter unit 30 uses the fixed blade 31 and the movable blade 32 to cut a desired length of the printed recording paper 10 from the rest of the paper. A portion of the printed recording paper 10 extends to outside the presenter unit 40 through the space provided by the open flapper 50, which makes it possible for a desired length of the recording paper 10 to be cut from the rest of the paper even when such a desired length is longer than the entire span of the transport path. FIG. 17 is an enlarged view of a portion enclosed by a chain-line circle 16A in FIG. 16.

Figure 18:
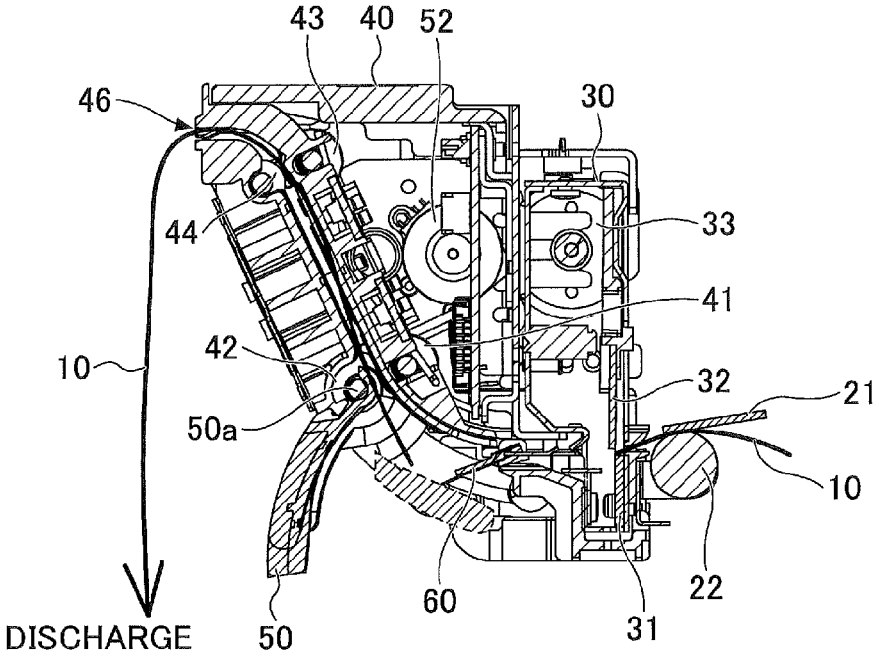
FIG. 18 is a drawing illustrating the opening and closing of the flapper of the printer according to the embodiment.
Figure 19:
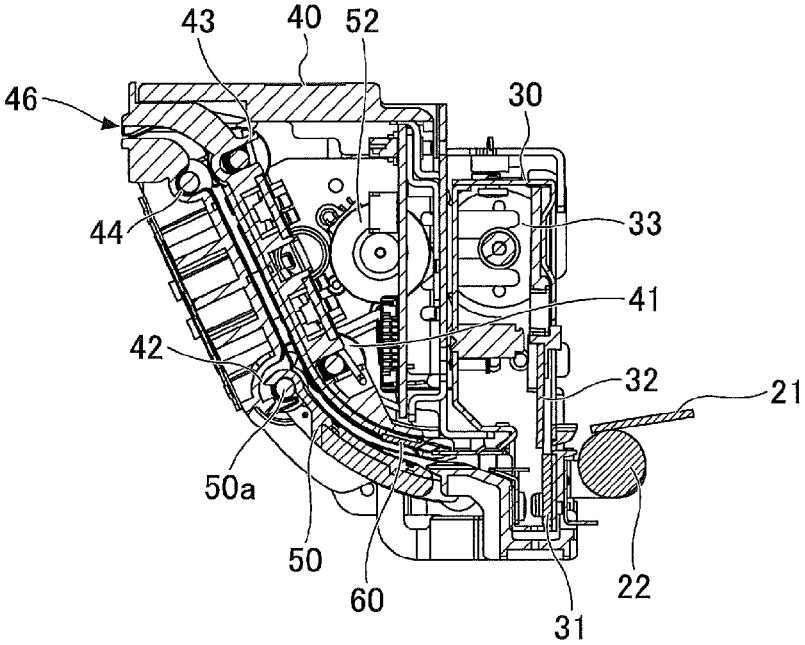
FIG. 19 is a drawing illustrating the opening and closing of the flapper of the printer according to the embodiment.

As illustrated in FIG. 18, the user pulls out the printed recording paper 10 having a portion thereof exposed from the discharge slot 46, so that the printed recording paper 10 is removed from the discharge slot 46. After the printed recording paper 10 is removed by the user, the flapper drive motor rotates in a reverse direction to close the flapper 50 and to return the recording paper transport guide 60 to its original position as illustrated in FIG. 19. The reverse rotation of the flapper drive motor 52 may be initiated by use of a sensor or the like detecting the discharge of the recording paper 10 from the transport path, for example.

Figure 20:
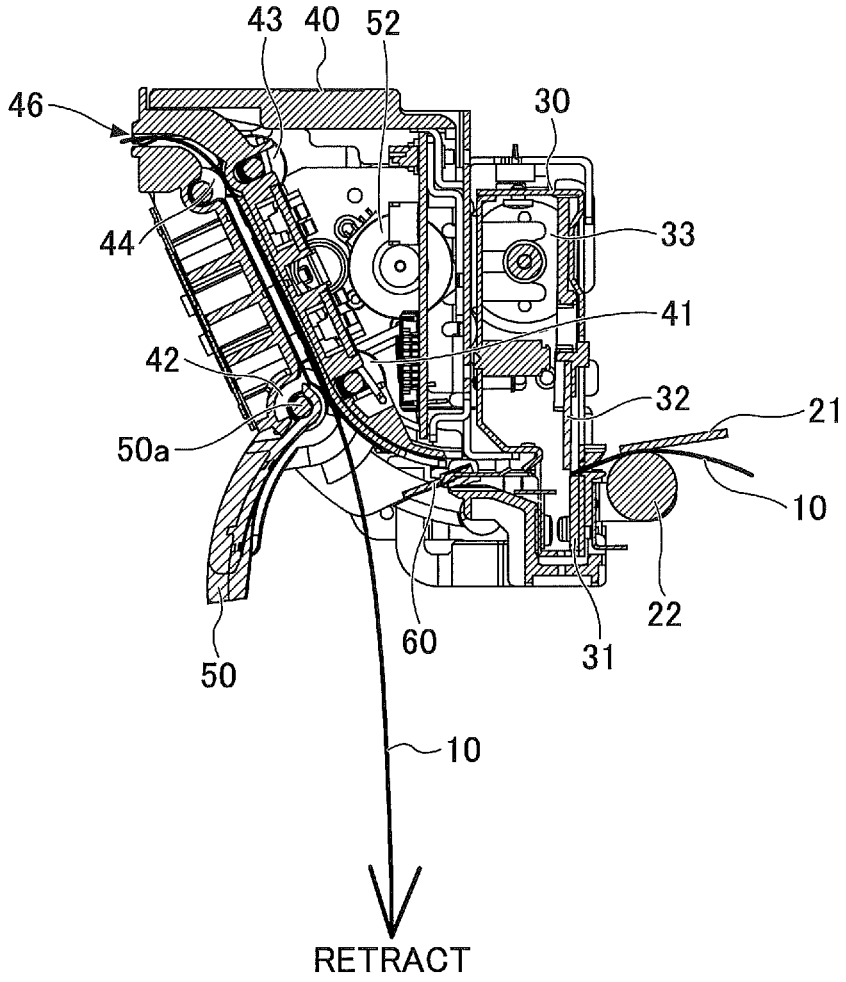
FIG. 20 is a drawing illustrating the opening and closing of the flapper of the printer according to the embodiment.

There may be a case in which the recording paper 10 having a portion thereof exposed from the discharge slot 46 is not removed by a user even after the passage of a predetermined time following the cutting of the recording paper 10. In such a case, the recording paper 10 is retracted as illustrated in FIG. 20. This is done for the purpose of preventing the printed recording paper 10 from being taken by an unintended user. The retraction of the recording paper 10 is performed by the reverse rotation of the transport roller 45 which causes the first roller 41 and the third roller 43 to be rotated in the reverse direction to convey the printed recording paper 10 in the reverse direction through the transport path. The recording paper 10 that has been conveyed in the reverse direction through the transport path in the presenter unit 40 is discharged to outside the presenter unit 40 through the space provided by the open flapper 50. Thereafter, as illustrated in FIG. 19, the flapper drive motor 52 rotates in the reverse direction to close the flapper 50 as well as to return the recording paper transport guide 60 to its original position.

When a next printing is performed on the recording paper 10, the same or similar operations as described heretofore will be performed.

Further, although the present invention is not limited to these embodiments, but various variations and modifications may be made without departing from the scope of the present invention.

The present application is based on and claims the benefit of priority of Japanese priority application No. 2014-039618 filed on Feb. 28, 2014, with the Japanese Patent Office, the entire contents of which are hereby incorporated by reference.

What is claimed is:

1. A printer, comprising:

a printer main body having a print head to print on recording paper and a platen roller;

a cutter unit configured to cut the recording paper; and a presenter unit connected to the cutter unit, wherein the recording paper on which the print head has printed enters the presenter unit through the cutter unit, and comes out from a discharge slot of the presenter unit, and wherein the presenter unit includes:

a first roller and a second roller configured to convey the recording paper;

a flapper disposed under a transport path of the recording paper between a position of the first roller and the second roller and a position of the cutter unit, and configured to be flipped open to provide an opening in the transport path; and a recording paper transport guide disposed over the transport path of the recording paper between the position of the first roller and the second roller and the position of the cutter unit, wherein, upon the flapper being flipped open to outside the presenter unit, the recording paper transport guide changes a position thereof to guide the recording paper to outside the presenter unit through the opening.

2. The printer as claimed in claim 1, wherein the presenter unit includes a motor, and the motor is driven to flip open the flapper.

3. The printer as claimed in claim 1, wherein the recording paper transport guide is disposed in the presenter unit in a rotatable manner, and the recording paper transport guide rotates due to its own weight upon the flapper being flipped open.

4. The printer as claimed in claim 1, wherein the recording paper transport guide is disposed in the presenter unit in a rotatable manner and provided with a spring, and the recording paper transport guide is rotated by a force exerted by the spring upon the flapper being flipped open.

5. The printer as claimed in claim 1, wherein the flapper is flipped open when the recording paper that is printed is placed between the first roller and the second roller whose rotations have been stopped.

6. The printer as claimed in claim 1, wherein upon the flapper being flipped open, and upon the recording paper transport guide changing a position thereof, the recording paper that is printed extends to outside the presenter unit through the opening provided by the flapper to have a slack.

7. A printer, comprising:

a cutter unit configured to cut recording paper; and a presenter unit configured to receive the recording paper from the cutter unit and to convey the recording paper through a transport path provided therein, wherein the presenter unit includes:

a flapper disposed beside the transport path and configured to be flipped open to provide an opening in the transport path; and a paper guide disposed to face the flapper across the transport path, wherein, upon the flapper being flipped open to outside the presenter unit, the paper guide intrudes into the transport path to deviate the recording paper from the transport path and to guide the recording paper to outside the presenter unit through the opening.

* * * * *